US005323182A

United States Patent [19]

Suzuki

[11] Patent Number: 5,323,182

[45] Date of Patent: Jun. 21, 1994

[54] METHOD OF POSITIONING A RECORDING HEAD WITH RESPECT TO A PLATEN ROLLER IN A RECORDING APPARATUS

[75] Inventor: Hiroyuki Suzuki, Tokorozawa, Japan

[73] Assignee: Kabushiki Kaisha Toshiba, Kawasaki, Japan

[21] Appl. No.: 817,889

[22] Filed: Jan. 9, 1992

[30] Foreign Application Priority Data

Jan. 11, 1991 [JP] Japan ..... 3-002290

[51] Int. Cl.[5] ..... B41J 2/32; B41J 11/02

[52] U.S. Cl. ..... 346/76 R; 346/76 PH; 346/136

[58] Field of Search ..... 346/76 PH, 1.1, 134.6; 400/120

[56] References Cited

U.S. PATENT DOCUMENTS 4,602,262 7/1986 Milligan et al. ..... 346/160

5,139,351 8/1992 Kamada ..... 400/120

FOREIGN PATENT DOCUMENTS 0032766 2/1986 Japan ..... 346/76 PH 0134285 6/1986 Japan ..... 346/76 PH

*Primary Examiner*—Benjamin R. Fuller

*Assistant Examiner*—N. Le

*Attorney, Agent, or Firm*—Finnegan, Henderson, Farabow, Garrett & Dunner

[57] ABSTRACT

A control method which is applied to a recording apparatus for recording picture information on a recording paper with use of a thermal recording head. The control method comprises a first step of feeding the recording paper upstream of a wait position and a second step of, following the first step, feeding the recording paper downstream to move the thermal and recording head to a downstream limit position, thereby preventing any movement of the thermal recording head during recording operation.

6 Claims, 4 Drawing Sheets

METHOD OF POSITIONING A RECORDING HEAD WITH RESPECT TO A PLATEN ROLLER IN A RECORDING APPARATUS

BACKGROUND OF THE INVENTION

1. Field of the Invention

The present invention relates to a method of controlling a recording apparatus which comprises a thermal recording head.

2. Description of the Related Art

In a conventional recording apparatus of the type which is built in a facsimile machine or the like, a positioning member having a slit is attached to a thermal recording head and a platen roller is fitted to the slit of the positioning member, thereby establishing positioning of the thermal recording head with respect to the platen roller. When data is recorded on a recording paper, the paper is fed to a cutting position where it is cut off. Then, the recording paper is returned such that the tip end thereof is positioned to a wait position.

When the platen roller is fitted in the slit of the positioning member, there is a slight gap based on a so-called fitting tolerance between the inner side wall of the slit and the bearing of the platen roller. Accordingly, when the platen roller is fitted in the slit, the thermal recording head has a looseness or play corresponding to the fitting tolerance in the paper feed direction. In other words, the thermal recording head is movable within the range corresponding to the fitting tolerance.

In the case where the recording paper is fed in the downstream direction for recording, if the thermal recording head is momentarily moved down to the downstream end of the aforementioned movable range, that is, if the shifting of the head is completed before the start of the recording operation of the head, the shift of the head will not adversely affect the recording quality.

However, the recording head will not always shift momentarily due to a friction between the top surface of the recording head and a depression spring provided in contact with the top surface of the head or due to a friction acting on a supporting member of the recording head.

For this reason, in the conventional method, the shifting of the recording head within the allowable range in the slit might occur after the start of the recording, which results in the following disadvantages.

That is, when the recording head is shifted downstream during the recording operation to the recording paper, the recording head is positioned on a part of the recording paper on which data has already been recorded.

In this case, when the above-mentioned part of the paper is recorded with an intermediate tone between black and white, a black line as a noise appears on that part of the paper along a main scanning direction of the head due to the double printing, which results in deterioration of the recording quality.

SUMMARY OF THE INVENTION

In view of the above respect, it is an object to provide a method of controlling a recording apparatus which can prevent any movement of a recording head during recording operations so as to achieve high quality recording.

In accordance with the present invention, there is provided a method of controlling a recording apparatus of the type wherein a platen roller is fitted into a slit formed in a positioning member attached to a thermal recording head so as to position the thermal recording head with respect to the platen roller, a recording paper already recorded is fed to a cut-off position where it is cut off, and then a tip end of the recording paper is retreated to the wait position, the method comprising a first step of feeding the recording paper upstream of the wait position and a second step of, following the first step, feeding the recording paper in the downstream direction to shift the thermal recording head to a downstream limit position.

In the present invention, since the shifting of the recording head to the downstream limit position is completed prior to the start of the recording operation, any double printing can be avoided and therefore a high quality recording can be attained.

DESCRIPTION OF THE PREFERRED EMBODIMENTS

Figure 1:
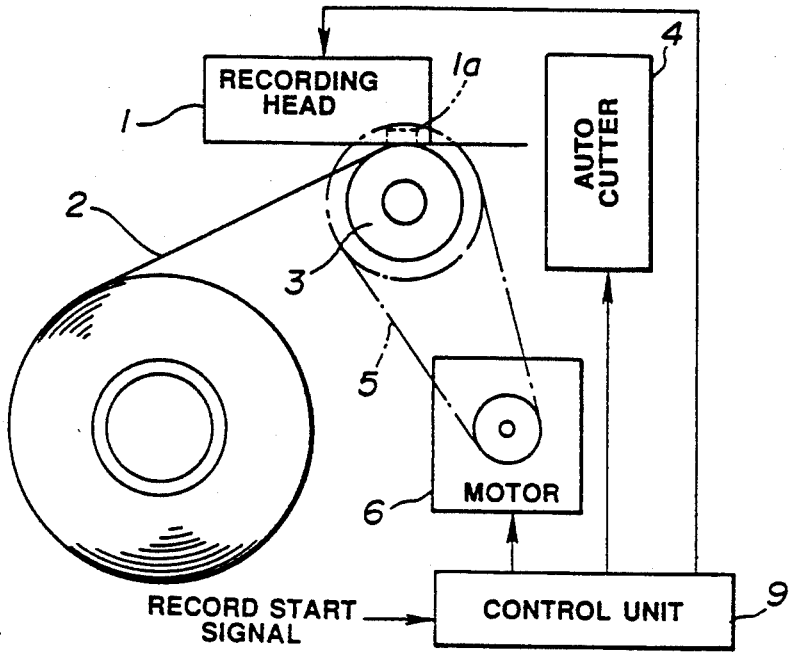
FIG. 1 conceptionally shows an example of a recording apparatus to which a control method in accordance with the present invention is applied.

Referring to FIG. 1, the recording apparatus comprises a thermal recording head 1, a platen roller 3 which is pressingly contacted with the recording head 1 with a recording paper 2 disposed therebetween, an automatic cutter 4 for cutting off the part of the recording paper 2 which is already recorded, and a motor 6 for driving the platen roller in the forward and backward rotations through a belt 5.

The recording apparatus is used for a facsimile machine, etc. In the recording apparatus, a heat-sensitive recording paper is employed as the recording paper 2.

Figure 3:
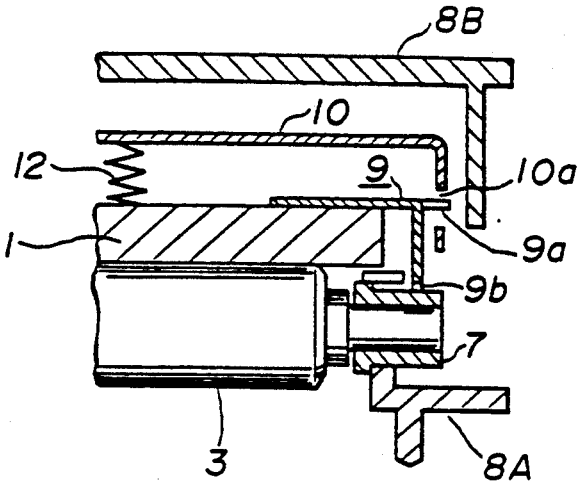
FIG. 3 is a partial cross-sectional view showing how the recording head and a platen roller are supported.

Referring to FIG. 3, the platen roller 3 is rotatably supported in a casing body 8A by means of a bearing 7, and the recording head 1 is carried on a casing lid 8B by means of a positioning member 9 and a supporting member 10.

Figure 2:
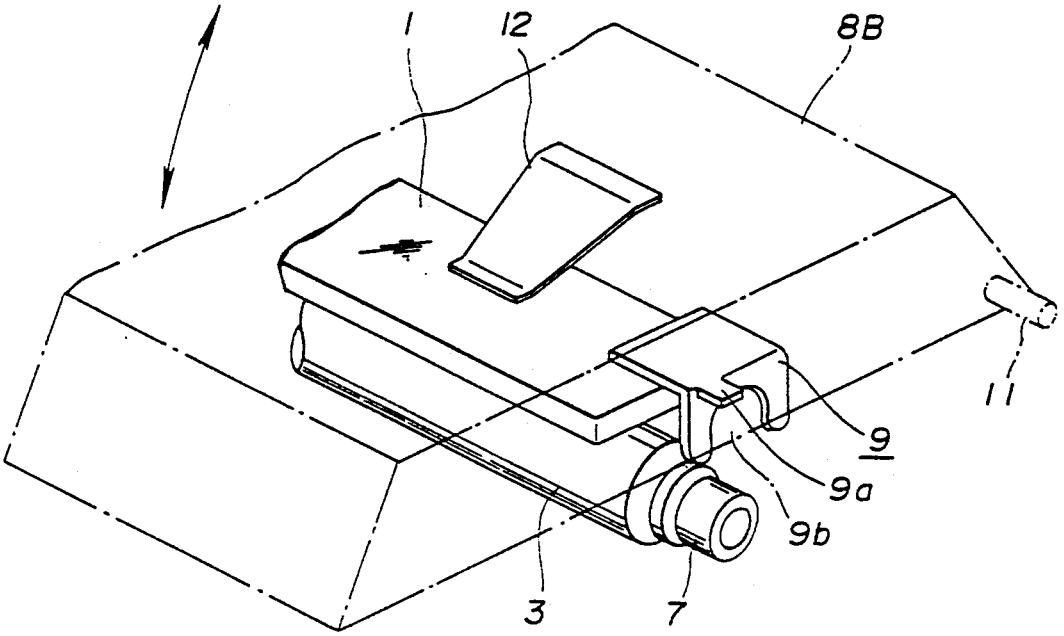
FIG. 2 is a perspective view showing the structure of a positioning member and how to mount the positioning member to a recording head.

As shown in FIG. 2, the positioning member 9, which is attached to one end of the recording head 1, is provided at its upper side with a supporting piece **9*a* and in its lower side with a slit 9*b***.

The supporting member 10, which is fixedly mounted inside the lid 8B, is formed in its side with a hole **10*a* into which the supporting piece 9*a* of the positioning member 9 is fitted. The hole 10*a* is dimensioned to be larger than the supporting piece 9*a*, so that the recording head 1 is supported inside the lid 8B** with a looseness or play.

Also disposed between the upper surface of the recording head 1 and the lower surface of the supporting member 10 is a plate spring 12 as shown in FIG. 2 which functions to bias the recording head 1 always in a downward direction.

The lid 8B is rotatably supported in the casing body 8A around a shaft 11 shown in FIG. 2 so that the lid 8B can be opened and closed around the shaft 11.

A slit **9*b* is provided in the positioning member 9 for the purpose of fittingly receiving the bearing 7 of the platen roller 3, and there exists a very small dimensional difference d based on a so-called fitting tolerance between the width of the slit 9*b* and the outer diameter of the bearing 7**.

The opening of slit **9*b* is positioned immediately above the bearing 7 when the lid 8B is closed to a certain extent. Then, guided by the bearing 7, the slit 9*b* is engaged with the bearing 7. At this stage, the slit 9*b* can smoothly be guided by the bearing 7 due to the aforementioned play present between the supporting piece 9*a* and the hole 10*a* of the supporting member 10**.

Figure 4:
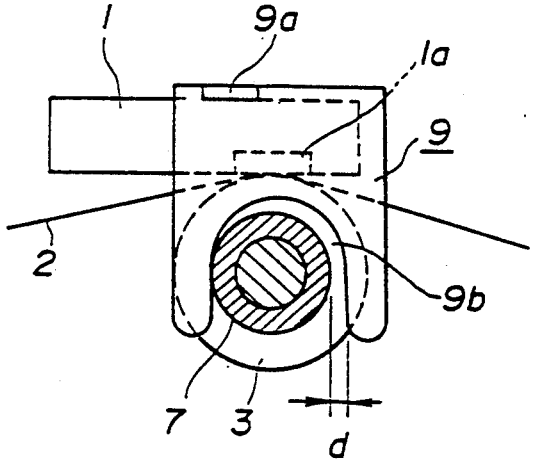
FIGS. 4 and 5 are conceptional views for illustrating different positions of the positioning member with respect to the platen roller.

When the lid 8B is fully closed, as shown in FIG. 4, heating elements **1*a* of the recording head 1 come into contact with the platen roller 3 with the recording paper 2 interposed therebetween, at which time the recording paper head 1 is pushed toward the platen roller 3 under the spring force of the plate spring 12**.

As will be clear from the foregoing explanation, the positioning member 9 functions to suitably position the heating element **1*a* of the recording head 1 relative to the platen roller 3**.

Figure 6:
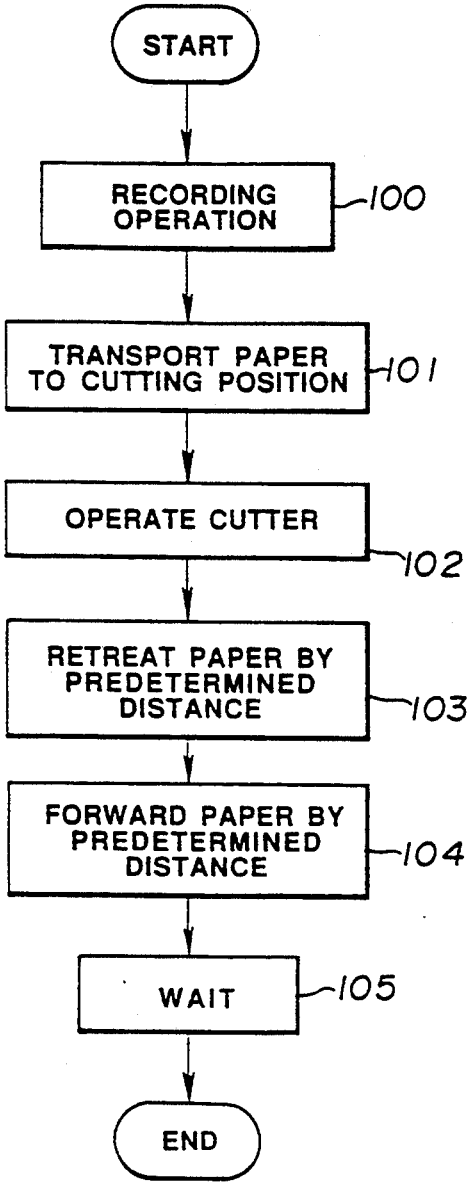
FIG. 6 is a flowchart showing the operation of an embodiment of the present invention.

Shown in FIG. 6 is a flowchart for explaining the control procedure of the recording apparatus. The procedure is executed under a controlling unit 9 shown in FIG. 1.

Figure 7:
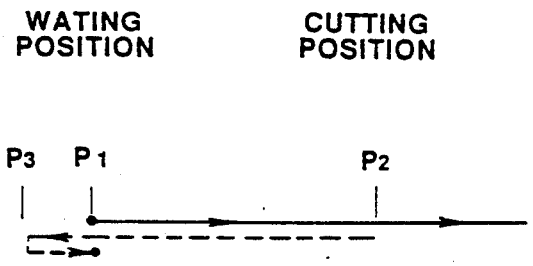
FIG. 7 is a diagram illustrating how a recording paper is transported in the embodiment of FIG. 6.

According to an embodiment of a control method of the present invention, when the recording apparatus is in its wait mode, the tip end of the recording paper 2 is positioned at a wait position $P_1$ in FIG. 7. The wait position $P_1$ is previously set as shifted by a proper distance to the downstream side (rightward in FIG. 1) from the heating elements **1*a* of the recording head 1**.

When a record start signal is sent to the controlling unit 9, the recording apparatus carries out the following recording operation (step 100).

That is, the platen roller 3 is rotated in the forward direction (clockwise in FIG. 1) at a speed suitable for recording so as to feed the recording paper 2 in the downstream direction (rightward direction of FIG. 1). During the paper feeding operation, the recording head 1 is operatively heated in response to a recording signal, whereby a picture data is recorded on the recording paper 2.

When completing the recording operation, the platen roller 3 is rotated forwardly so that the recording paper 2 is fed until the already-recorded part of the recording paper 2 is located downstream of a cut position $P_2$ (step 102). Then, the automatic cutter 4 cuts off the already-recorded part of the recording paper 2 (step 101). The cut-off part is discharged by means of a discharge roller (not shown).

In FIG. 7, a movement of the tip end of the recording paper in the steps 100 and 101 is shown by a solid line.

When the recording paper 2 is cut off, the platen roller 3 is rotated counter-clockwise, whereby the recording paper 2 is fed in the upstream direction (leftward direction of FIG. 1) (step 103). This paper feeding operation is continued until the tip end of the recording paper 2 reaches a position $P_3$ set upstream the wait position $P_1$ as shown by a dotted line in FIG. 7.

In the steps 101 and 102, during the downstream feeding operation of the recording paper 2, the recording head 1 is energized in the rightward direction under the influence of a frictional force between the recording head 1 and the recording paper 2.

Consequently, at the time of the feed start point of the recording paper 2 in the step 103, as shown in FIG. 4, the left inward face of the slit **9*b* of the positioning member 9 abuts against the bearing 7 of the platen roller 3. That is, the recording head 1** is shifted to its downstream limit position.

At this time, there is a gap d based on the fitting tolerance between the right inner face of the slit **9*b* and the bearing 7**.

Figure 5:
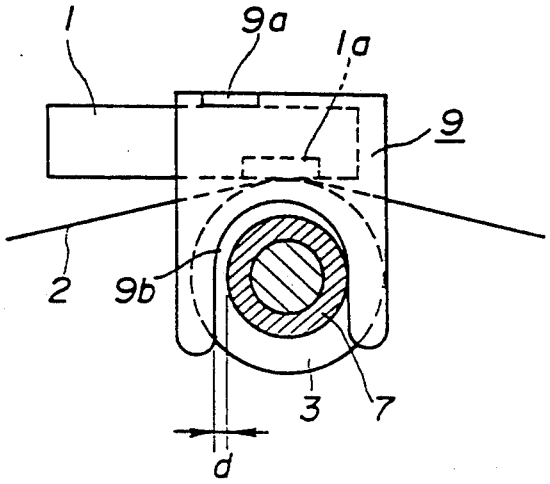

When the recording paper 2 is fed in the upstream direction in the step 103, on the other hand, the recording head 1 is energized in the leftward direction. When the tip end of the recording paper 2 reaches the position $P_3$, as shown in FIG. 5, the right inner face of the slit **9*b* abuts against the bearing 7 of the platen roller 3, which results in that the gap d is formed between the left inner face of the slit 9*b* and the bearing 7. That is, the recording head 1** is shifted to its upstream limit position.

After the paper feeding operation of the step 103 is completed, the platen roller 3 is rotated forwardly so that the recording paper 2 is fed by a predetermined distance in its forward direction (in the downstream direction) (step 104). That is the recording paper 2 is fed until the tip end of the paper 2 reaches the wait position $P_1$ from the point $P_3$.

When the paper feeding operation of the step 104 is completed, the recording apparatus is put in the wait state (step 105).

The downstream feeding of the recording paper 2 in the step 104 causes the recording head 1 to be biased in the rightward direction. Accordingly, when the tip end of the recording paper 2 reaches the wait position $P_1$, as shown in FIG. 4, the left inward face of the slit **9*b* abuts against the bearing 7 of the platen roller 3**.

Thereafter, each time the controlling unit 9 receives the record start signal, the aforementioned procedure is executed. In the foregoing embodiment, the recording head 1 is located in a downstream limit position as shown in FIG. 4 in the wait mode of the recording apparatus, as already explained. Hence, there is no danger that the recording head 2 is moved in the rightward direction during the recording operation of the step 100 and therefore high quality recording can be achieved.

In the wait mode, if the recording head 1 is located at an upstream limit position as shown in FIG. 5, then the head 2 is moved to the downstream direction by the gap d during the feeding operation of the recording paper 2 for recording operation, which results in that the recording head 2 is positioned on the already-recorded part of the recording paper 2.

In this case, when the already-recorded part has an intermediate tone between black and white, the double recording of the head 2 results in appearance of a black line as a noise on the already-recorded part along the main feeding direction of the head 1 and thus in degradation of the recording quality.

In the case where the thermal recording head 1 has a resolution of 100 um–200 um, even a slight shift in the downstream position of the head 1 causes the generation of such a disadvantage as mentioned above.

Figure 8:
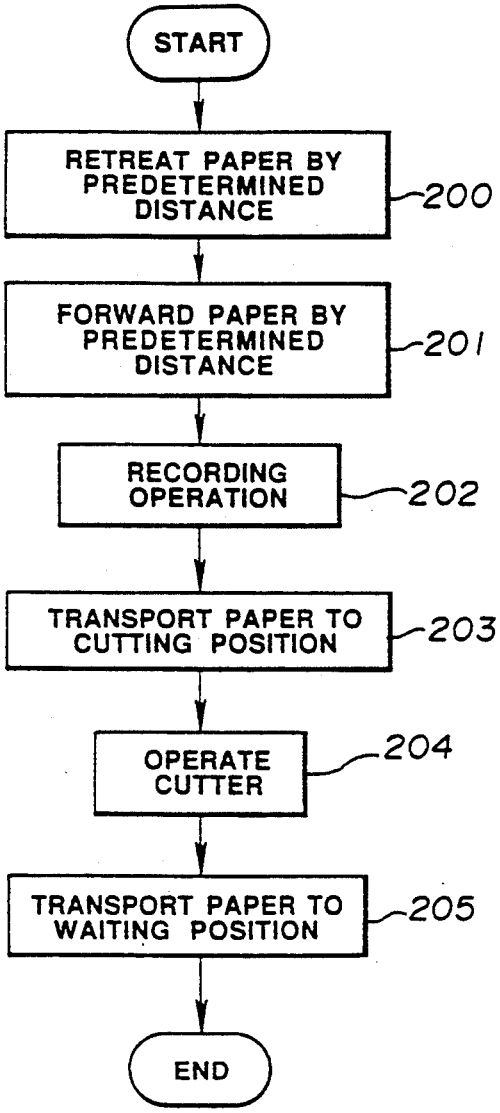
FIG. 8 is a flowchart showing the operation of another embodiment of the present invention.

FIG. 8 shows another embodiment of the present invention. In this embodiment, when the controlling unit 9 receives the record start signal, the platen roller 3 is rotated in its backward direction, so that the tip end of the recording paper 2 is retreated to the position $P_3$ from the wait position $P_1$ (step 200). Then the platen roller 3 is rotated forwardly so that the tip end of the recording paper 2 is again advanced to the wait position $P_1$ (step 201).

When the tip end of the recording paper 2 arrives at the wait position $P_1$, the recording and paper-feeding operations are performed in substantially the same manner as in the step 100 in FIG. 6 (step 202). During the recording operation, the recording paper 2 is fed in the downstream direction, during which the thermal recording head 1 will not be subjected to any change in the downstream position. This is because, prior to the start of feeding the paper for recording, the recording head 1 is previously shifted to a downstream limit position as shown in FIG. 4 by the paper feeding operation of the step 201.

Figure 9:
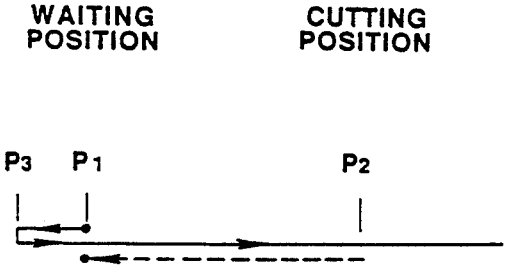
FIG. 9 is a diagram illustrating how the recording paper is transported in the embodiment of FIG. 8.

After completion of the recording operation of the step 202, paper feeding and cut-off operations are sequentially carried out (steps 203 and 204) in substantially the same manner as in the steps 101 and 102 in FIG. 6. After this, as shown by a dotted line in FIG. 9, the recording paper 2 is fed in the upstream direction until the tip end of the paper 2 is returned to the wait position $P_1$ (step 205). When the processing of the step 205 is completed, the recording apparatus is put in the wait state.

As will be clear from the foregoing explanation, in the embodiment of FIG. 8, the shifting of the recording head 1 to a downstream limit position as shown in FIG. 4 is carried out prior to the recording operation.

Although the control method of the foregoing embodiments has been applied to the recording apparatus of FIG. 1 using the heat sensitive recording paper 2, the present control method may be applied to a recording apparatus using an ordinary non-heat sensitive paper as the recording paper. In this case, an ink film is disposed between the recording head 1 and the recording paper.

Even when the control method of the foregoing embodiments is employed, it is preferable to reduce or minimize the frictional force between the spring 12 and the upper surface of the recording head 1 in FIG. 2. To this end, a lubricating resin plate may be provided on the top surface of the recording head 1 located at the pressing point of the spring 12 and further lubricating oil may be applied onto the top surface of the resin plate.

What is claimed is:

1. A method of positioning a recording head with respect to a platen roller in a recording apparatus, wherein the recording apparatus includes a thermal recording head, a platen roller pressed against the thermal recording head for feeding recording paper between the thermal recording head and the platen roller when the platen roller rotates, and a positioning member provided at the thermal recording head having a slit into which the platen roller is disposed for positioning the thermal recording head in a feeding direction of the recording paper, wherein the recording paper follows a paper feeding path sequentially provided with a wait position and a cut position downstream of the thermal recording head, and wherein the recording apparatus is constructed such that the thermal recording head records on the recording paper while the recording paper is fed from the wait position to the cut position, and after recording is completed, a recorded portion of the recording paper is cut off at the cut position, and then a tip end of the recording paper is returned to the wait position, the method of positioning the recording head with respect to the platen roller in the recording apparatus comprising the steps of:

feeding the tip end of the recording paper from the wait position to an intermediate position provided between the wait position and the thermal recording head;

feeding the tip end of the recording paper from the intermediate position to the wait position while applying a force on the recording head due to friction between the recording paper and the thermal recording head, wherein a distance between the wait position and the intermediate position corresponds to a gap generated due to a fitting tolerance between an upstream side abutment surface of the slit and the platen roller and is eliminated by the force generated due to the friction between the recording paper and the thermal recording head.

2. A method of controlling a recording apparatus as set forth in claim 1, wherein said feeding step is carried out following the return movement of said recording paper to said wait position.

3. A method of controlling a recording apparatus as set forth in claim 1, wherein said feeding step is carried out as soon as a record start signal is generated.

4. A method of controlling a recording apparatus as set forth in claim 1, wherein said recording apparatus employs a heat sensitive recording paper as said recording paper.

5. A method of controlling a recording apparatus as set forth in claim 1, wherein said recording apparatus employs an ordinary non-heat sensitive paper as said recording paper and an ink film is disposed between said ordinary paper and said thermal recording head.

6. A method of positioning a thermal recording head with respect to a platen roller in a recording apparatus, wherein the recording apparatus includes a positioning member having a slit, with upstream and downstream edges, in which the platen roller is disposed, to align the thermal recording head with the platen roller, the method comprising the steps of:

feeding a tip end of a recording paper a distance from a wait position, downstream from the thermal recording head, to an intermediate position between the wait position and the thermal recording head, wherein the distance corresponds to a fitting tolerance between the downstream edge of the slit and the platen roller; and feeding the tip end of the recording paper from the intermediate position to the wait position, thereby moving the thermal recording head the distance by frictional engagement with the paper to bring the upstream edge of the slit into engagement with the platen roller.

* * * * *